United States Patent [19]

Ouchi et al.

[11] Patent Number: 4,675,055

[45] Date of Patent: Jun. 23, 1987

[54] METHOD OF PRODUCING TI ALLOY PLATES

[75] Inventors: Chiaki Ouchi; Hiroyoshi Suenaga, both of Yokohama; Hideo Sakuyama, Toda; Michio Hanai, Kanagawa; Ichiroh Sawamura, Toda, all of Japan

[73] Assignees: Nippon Kokan Kabushiki Kaisha; Nippon Mining Co., Ltd., both of Tokyo, Japan

[21] Appl. No.: 729,299

[22] Filed: May 1, 1985

[30] Foreign Application Priority Data

May 4, 1984 [JP] Japan ..... 59-88361
Oct. 30, 1984 [JP] Japan ..... 59-226884

[51] Int. Cl.[4] ..... C21D 8/02

[52] U.S. Cl. ..... 148/11.5 F; 148/20.3; 148/133

[58] Field of Search ..... 148/11.5 F, 12.7 B, 148/13.1, 133, 20.3, 421; 420/420

[56] References Cited

U.S. PATENT DOCUMENTS 3,169,085 2/1965 Newman ..... 148/421
3,584,368 6/1971 Sargent, Jr. ..... 148/11.5 F
3,649,374 3/1972 Chalk ..... 148/12.7 B
3,686,041 8/1972 Lee ..... 148/11.5 F

FOREIGN PATENT DOCUMENTS 682311 8/1979 U.S.S.R. ..... 148/11.5 F

*Primary Examiner*—Christopher W. Brody
*Attorney, Agent, or Firm*—Frishauf, Holtz, Goodman & Woodward

[57] ABSTRACT

A method for producing Ti alloy plates, comprising heating an $\alpha+\beta$ Ti alloy ingot to a temperature within the $\alpha+\beta$ two phase range, forging or rolling said heated alloy ingot to reduce it more than 30% whereby strain energy accumulates in said ingot as it is being reduced, and reheating said reduced ingot containing said accumulated strain energy to a temperature of the $\alpha+\beta$ phase range and then hot rolling said reheated reduced ingot so that it is further reduced in an amount more than an additional 30% whereby said accumulated strain energy accelerates recrystallization during said hot rolling to produce a uniform alloy structure, said heating and reheating being carried out in an atmosphere having not more than 0.02 atm oxygen partial pressure.

1 Claim, 4 Drawing Figures

(No.1 As-Roll)

(No.1 STA)

(No.6 As - Roll)

(No.6 STA)

METHOD OF PRODUCING TI ALLOY PLATES

RELATIVE ART

Ti alloy materials have light weight and excellent features such as high strength and high corrosion resistance, and so those have been mainly used as materials for airframes and aerospace vehicles or the like.

The Ti alloys are classified into $\alpha$ type, $\alpha+\beta$ type and $\beta$ type. The present invention is to provide a new method of producing $\alpha+\beta$ Ti alloy.

The Ti alloy is however one of the materials which are difficult to be processed, and it has been conventional to improve uniformity of alloy structure or mechanical properties. Many studies have been made of rolling reduction of the alloy plates or hot rolling processes.

For producing, e.g., $\alpha+\beta$ Ti alloy plate, a slab of large width is utilized, which has been prepared by subjecting an ingot to a forging or cogging, and for producing this slab, a process is undertaken in the $\beta$ range where deformation resistance is low. The Ti alloy plate is produced by a further hot rolling said slab, and unfortunately such an alloy is in general considerably inferior in the uniformity of the alloy structure and the mechanical properties (especially elongation), and it is easily created with cracks in the surface thereof.

SUMMARY OF THE INVENTION

The present invention has been realized to improve the above mentioned defects involved with the prior art, and is to provide a method of producing Ti alloy materials which have uniform structures and excellent mechanical properties such as elongation.

The invention is to provide a method of producing Ti alloy materials which do not have cracks on the surfaces thereof during the hot rolling or the forging.

In this invention, $\alpha+\beta$ Ti ingot is forged or rolled to a total reduction rate of more than 30% at temperatures of $\alpha+\beta$ phase range in order to produce an intermediate material. The intermediate material is re-heated and is subjected to a required hot work. In this process, the material accumulates strain energy by the process at the temperatures of $\alpha+\beta$ phase range, and in the subsequent hot-work, recrystrallization is accelerated by said strain energy in the re-heating process, and the structure becomes uniform.

In the invention, a slab may be made as an intermediate material and a rolled plate as the manufactured product. On the other hand, a bloom or a billet may be provided as an intermediate material and a bar material as the manufactured product. The hot-work after the re-heating may employ appropriate steps such as hot-rolling or forging.

The heating for processing $\alpha+\beta$ alloy material is performed in an atmosphere of not more than 0.02 atm oxygen partial pressure. This performance may control oxidized scale to be formed on the surface of the material or formation of oxygen enriched layer, so that cracks caused at processing of the material surface may be avoided.

With respect to the heating in the atmosphere of not more than 0.02 atm oxygen partial pressure and the following, those processes may be carried out independently, or may be incorporated with the heating and the processing of Ti alloy ingot, or may be applied to the re-heating of the intermediate material.

DETAILED DESCRIPTION OF PREFERRED EMBODIMENTS OF THE INVENTION

Figure 1A:
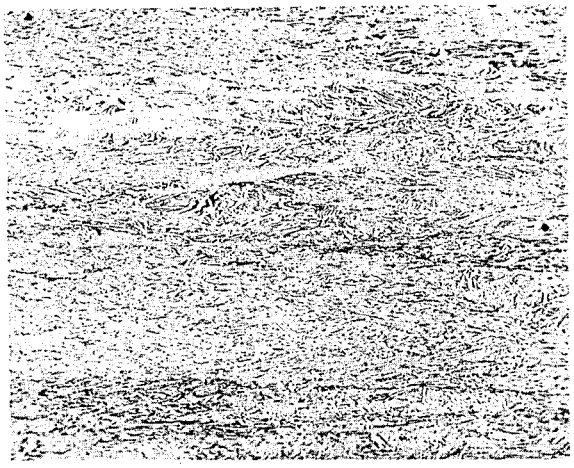
FIG. 1 (A) and (B) are microscopically enlarged photographs of structures of No. 1 material in Table 2, wherein (A) shows a as-rolled material and (B) shows a heat-treated material.

The present invention will be explained on a method of producing Ti alloy plates.

In producing $\alpha+\beta$ Ti alloy plate, a slab is prepared from an ingot through forging or cogging, and it is hot-rolled. The plate having passed through said steps is deteriorated in the uniformity of the material structure or the mechanical properties. The reason is because the slab produced in the $\beta$ range is slowly cooled at ambient temperatures around the transformation point of $\beta \rightleftarrows \alpha+\beta$, whereby coarse $\alpha$ crystallites in grain boundary are precipitated as a net-work in the previous $\beta$ boundaries, and parts of said coarse $\alpha$ crystallites do not disappear after the hot rolling and the following heat treatment but are retained. There has not been a practice to control processing conditions in the slab making stage due to the properties or structures of the slab.

The inventors made studies on the relationship between the slab producing conditions, the structures and properties of the obtained Ti alloy plates. As a result, they found that if the process was performed on the ingot at the termperatures of $\alpha+\beta$ phase range in the slab making stage, the uniformity of the structure and the mechanical properties such as elongation after the hot rolling were considerably improved.

That is, for eliminating the coarse $\alpha$ crystallites in the grain boundary like network precipitated in the slab making stage, recrystallization should be necessarily be caused to take place accompanying dispersion, and it has been found that strain energy is accumulated in the slab by the process carried out at the above mentioned temperatures, and this strain energy accelerates the recrystallization in the course of re-heating in a subsequent hot-rolling, whereby the uniformity of the structure is attained.

Therefore, in this invention $\alpha+\beta$ Ti alloy ingot is subjected to forging or rolling at the total reduction of more than 30% in the range of the $\alpha+\beta$ phase temperature, and the resultant obtained slab is hot-rolled after the re-heating.

By the inventors' further studies, it has been found that the latter hot rolling should be performed at the temperatures of the $\alpha+\beta$ phase range, in addition to the process at the temperatures of the $\alpha+\beta$ phase range in the slab making process prior to said hot rolling procedure, whereby the structure is made more uniform after the heat treatment of the hot rolled plate.

This fact means that the slab which has accumulated the strain energy by the process in the $\alpha+\beta$ phase range as mentioned above, is heatd to the temperature of $\alpha+\beta$ phase range where the coarse $\alpha$ crystallites in the grain boundary like net work are not precipitated, and thereby the recrystallization takes place and the structure becomes uniform. Then if the hot-rolling is further carried out at said $\alpha+\beta$ phase temperature range, the strain energy accumulates, and due to this strain energy the recrystallization is accelerated in the subsequent heat treatment, and the structure is made more uniform. In this point, it is preferable to maintain the temperatures before and during the hot-rolling at ranges between $\beta$ transformation point (preferably $\beta$ transformation point minus more than 50° C.) and $\beta$ transformation point minus not more than 200 ° C.

In view of such circumstances, in this invention, $\alpha+\beta$ Ti alloy ingot is subjected to the forging or rolling thereon at the termperatures of $\alpha+\beta$ phase range at the total reduction rate of more than 30% to turn out a slab. Said slab is re-heated at the temperatures of $\alpha+\beta$ phase range, followed by the hot rolling of the total reduction rate of more than 30%.

The $\alpha+\beta$ Ti alloy decreases in hot workability at the temperatures of $\alpha+\beta$ phase range, and therefore if such a slab has the coarse $\alpha 0$ crystallites in the net work grain boundaries when the process is undertaken at said temperatures, tortoise shell like cracks are created from said coarse crystallites starting points.

In the invention, since the slab with said $\alpha$ crystallites is used as the raw material and the hot rolling is performed thereon, the cracks on the surface may be prevented, and it is possible to produce the hot rolled plates having excellent surface properties.

An explanation of the manufacturing conditions of the present invention follows.

The $\alpha+\beta$ alloy ingot is heated to temperatures between $\beta$ transformation plus not more than the 100° C. point and $\beta$ transformation point minus not more than 200° C. and it is not performed with forcible cooling on the half way but is successively treated with forging or cogging at temperatures from the $\beta$ range to the $\alpha+\beta$ range or the temperatures of the $\alpha+\beta$ phase range, at a total reduction rate of more than 30% at the $\alpha+\beta$ phase range, and is finally formed into a slab of a determined size. The ingot is heated in the batch furnace or the continuous furnace. The heating temperatures are limited as above for following reasons. At the heating temperatures of $\beta$ transformation point more than 200° C. below said transformation point, the hot workability of $\alpha+\beta$ Ti alloy is considerably decreased, and surface crackings are caused, and the hot deforming resistance is increased, so that the rolling will be difficult. On the other hand, if exceeding the heating temperature of $\beta$ transformation point plus 100° C., the surface of the Ti alloy ingot is remarkably oxidized, so that loss by scale is great, and surface cracks are caused during rolling.

The processing in the above mentioned $\alpha+\beta$ phase temperature range requires that the total reduction rate is more than 30%. If it were less than 30%, the accumulated strain energy would be insufficient, and the uniformalizing effect of the structure would not be fully provided in the ensuing hot rolling procedure. A slab produced under such processing conditions is re-heated after the cooling, and hot-rolled into Ti alloy plate.

The hot rolling conditions are as follows.

The heating temperature is specificed as the $\alpha+\beta$ phase range for following reasons. Based on the strain energy accumulated in the material during the heating procedure at said temperatures, the recrystallization progresses and the structure is made uniform. However, if the slab were heated to the $\beta$ range higher than the $\alpha+\beta$ range, it would be cooled at the ambient temperatures of $\beta \rightleftarrows \alpha+\beta$ transformation, and the coarse $\alpha$ crystallites of the net work grain boundary would be precipitated in the previous $\beta$ boundary, and the objective uniformalization of the slab structure would be spoiled.

Further, if the total reduction rate were less than 30%, an expected uniformalizatizing effect could not be obtained in the heat treating procedure of the hot rolled plate. In addition, the inventors made investigations on the surface cracks during the hot rolling, and found that the hot workability (interior workability) of the $\alpha+\beta$ Ti alloy material per se was satisfactorily conditioned, for example, no problem arose in the hot workability in a vacuum heating; the surface crackings during the hot-rolling were caused by oxidation of the slab surface in the roll heating of the Ti alloy slab; and said crackings were controlled by controlling the atmosphere in the roll heating of the Ti alloy slab.

That is to say, the $\alpha+\beta$ Ti alloy slab is in general heated in the batch furnace or the continuous furnace in an oxidizing atmosphere in order not to absorb hydrogen. Therefore, the slab is formed with oxidized scales or the oxygen enriched layer on the surface thereof, so that susceptibility of the surface cracks at the hot rolling is increased. If the heating atmosphere in the roll heating is controlled, it is possible to control the formation of oxidized scale and the enrichment of oxygen on the slab surface and to control the susceptability to forming cracks during hot rolling.

In this regard, in the present invention, the atmosphere of the roll heating is limited at not more than 0.02 atm oxygen partial pressure. If exceeding this limitation, it is not possible to check appearance of the oxidized scale and to prevent surface cracks in the hot rolling. The heating temperature and time may be selected in dependence upon kinds of $\alpha+\beta$ Ti alloys, ability of the rolling facility, and slab thickness. Heating furnaces, such ones may be used in which it is possible to control the oxygen partial pressure, for example, the vacuum furnace or Ar, He atmospheric furnaces.

The above explanation refers to the production of Ti alloy plate, and any limitations are not provided to shapes of the materials and hot working processes, and the invention includes such a process which uses the bloom or billet as the raw material, and undertakes the hot work thereon to produce bar material.

EXAMPLE 1

Ti-6% Al-4% V alloy ingot (diameter: 550 mm), which was a representative $\alpha+\beta$ Ti alloy and had the chemical composition shown in Table 1, was heated to the temperature of 1050° C. and was subjected to the cogging. The obtained slab was passed through the hot rolling and finished in a rolled plate of 36 mm thickness within a range of the temperatures between 950° C. and 800° C. The investigations were made on the as-rolled materials and the materials passed, after said rolling, through the heat treatment (955° C.×1.5 hr→W.Q+538° C.×6 hr→A.C) with respect to mechanical properties thereof. Results are shown in Table 2 together with the producing conditions. Test pieces were obtained in parallel to the rolling direction, and 8.75 mm$\phi$ of parallel portions from the center of the thickness and G.L 35 mm. The heat treatments were performed on the test pieces of 125 mm (1)×100 m(w)×12.5 mm(t). In the structure of the $\alpha+\beta$ Ti alloy, macrographic irregularity is a problem. The regularities of the structures of STA material (Solution Treatment and Aging) were made to average grain size (average of 30 grains) of $\alpha$ crystallines in the cross section in parallel to the rolling direction, per 100 parts thereof, and the standard deviations of the average grain diameter were compared in the rolling conditions for valuation. The surface properties of the rolled plates were evaluated by visually measuring lengthes of the surface cracks of more than 0.5 mm depth in the 100 $cm^2$ surface area.

Figure 2A:
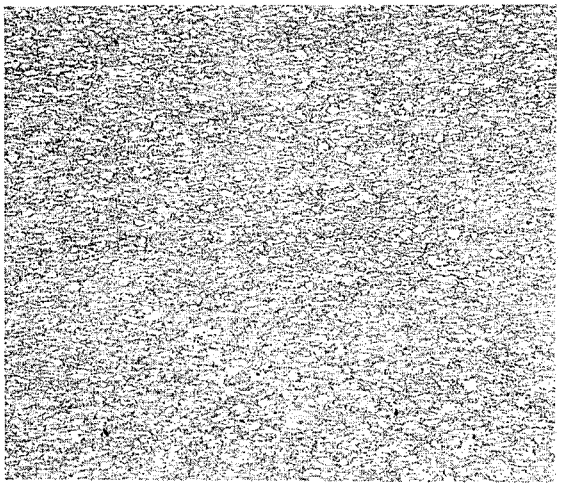
FIG. 2 (A) and (B) are microscopically enlarged photographs of structures of No. 6 material in Table 2, wherein (A) shows a as-rolled material and (B) shows a heat-treated material.

FIG. 1(A) and (B), and FIG. 2(A) and (B) are microscopically enlarged photographs (100 magnification) of the structures of No. 1 material (comparative) and No. 6 material (inventive) of Table 2.

Figure 1B:
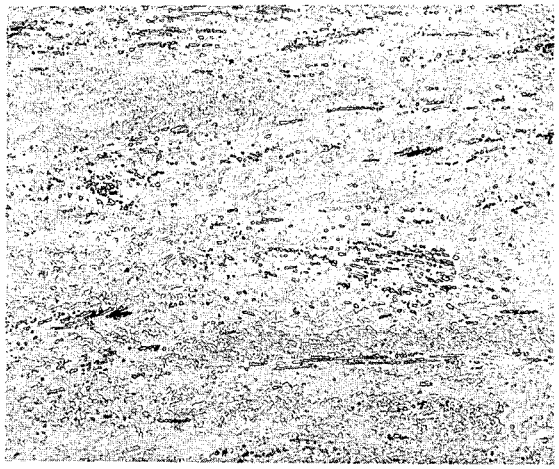
Figure 2B:
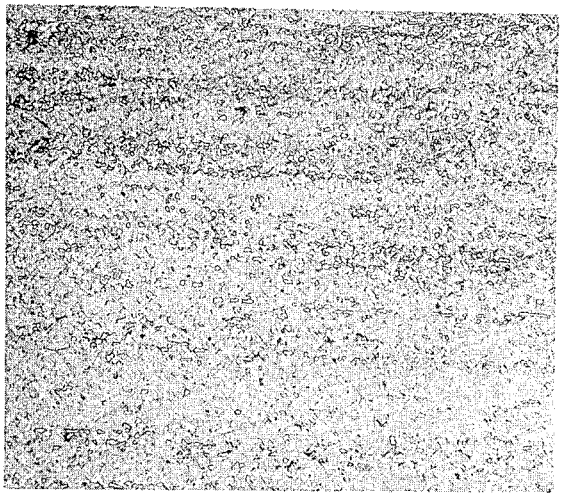

According to Table 2, FIGS. 1 and 2, it is seen that if the rolling conditions of the slabs of the invention are satisfied and the total reduction rate at the temperatures of the $\alpha+\beta$ phase range is more than 30%, the mechanical properties (especially ductility) after the hot rolling are largely improved. With respect to the standard deviation of the average grain diameter, if the total reduction rate at the temperatures of the $\alpha+\beta$ phase range is more than 30%, the standard deviation of the average grain diameter after the hot rolling is small and the structure is uniformalized. Besides, the slabs by the method of the invention have the excellent surface cracking resistance, and it is seen that the $\alpha+\beta$ Ti alloy plates by the invention are controlled from the surface cracks, and are provided with the excellent surface property. Especially, Nos. 8 to 10 materials were heated in the atmosphere of 0.02 atm oxygen partial pressure and reveal no surface cracks, and it is recognized that those are especially excellent against the surface cracks.

The present invention is not limited to those alloys in the above example but applicable to general Ti alloys of $\alpha+\beta$ type, for example, Ti-6% Al-6% V-2% Sn alloy

EXAMPLE 2

Ti-6% Al-4% V of Table 3 was hot-rolled by changing the oxygen partial pressure and the heating condition.

The ingot of 550 mm diameter was performed with the forging at the $\beta$ range, and the slab was made. This slab was heated to the temperature of 950° C., followed by the hot rolling, and was finished in a rolled plate of 32 mm thickness. The reduction during each pass was about 10%, and the roll finishing temperatures were changed between 650° C. and 900° C. The surface property of the rolled plate was evaluated by visually measuring lengthes of the surface cracks of more than 0.5 mm depth in the 100 $cm^2$ surface area. Table 4 shows the relationship between the heating conditions and the surface properties. The vacuum furnace or the Ar or He atmospheric furnace were used. The slabs were heated in the atmosphere of not more than 0.02 atm oxygen partial pressure. It is seen that the surface properties of the hot rolled plates of the $\alpha+\beta$ Ti alloy were greatly improved.

TABLE 1

| (wt %) | | | | | | | |
|---|---|---|---|---|---|---|---|
| Al | V | Fe | C | O | N | H | Ti |
| 6.50 | 4.20 | 0.28 | 0.004 | 0.14 | 0.0139 | 0.0037 | Rest |

TABLE 3

| | (wt %) | | | | | | |
|---|---|---|---|---|---|---|---|
| | Al | V | Fe | C | O | N | H |
| Ti—6% Al—4% V | 6.73 | 4.26 | 0.28 | 0.003 | 0.195 | 0.014 | 0.0004 |

TABLE 4

| Heating conditions and surface properties (Cracked length: cm) | | | | | | | | |
|---|---|---|---|---|---|---|---|---|
| | A | | | | | | | |
| | Invention | | | | Comparative examples | | | |
| | 0.02 atm | | | | 0.3 atm | | 0.03 atm | |
| | B | | | | | | | |
| | Vacuume furnace | | Ar furnace | He furnace | Atmospheric furnace | | Vac. fur. | Ar fur. |
| C | 1 hr | 6 hr | 6 hr | 6 hr | 1 hr | 6 hr | 1 hr | 1 hr |
| 900° C. | 0 | 0 | 0 | 0 | 0 | 2 | 0 | 0 |
| 850° C. | 0 | 0 | 0 | 0 | 3 | 8 | 1 | 2 |
| 800° C. | 0 | 0 | 0 | 0 | 10 | 61 | 10 | 9 |
| 750° C. | 0 | 0 | 0 | 0 | 31 | 107 | 26 | 28 |
| 700° C. | 0 | 0 | 0 | 0 | 69 | 185 | 61 | 66 |
| 650° C. | 0 | 0 | 0 | 0 | 91 | 218 | 79 | 75 |

Note:
A - Oxygen partial pressure
B - Heating conditions
C - Finishing temperatures

TABLE 2

| | Slab producing conditions (Finish: 120 mm) * | | | | Rolling condition (Cross ratio: 1) | | | Mechanical properties | | | | | | |
|---|---|---|---|---|---|---|---|---|---|---|---|---|---|---|
| No | B | D | C | E | B | C | E | Treatments | Y.S kg/$mm^2$ | T.S Kg/$mm^2$ | El Kg/$mm^2$ | RA (%) | F *2 | G |
| | | | | | | | | COMPARISON | | | | | | |
| 1 | 1050 | H | 1010 | 0 | 950 | 800 | 70 | As Roll | 104.3 | 109.5 | 10.2 | 30.0 | 0.61 | 61 |
| | | | | | | | | STA | 110.0 | 116.8 | 7.8 | 16.2 | | |
| 2 | " | " | 900 | 20 | " | " | " | As Roll | 104.5 | 109.5 | 12.0 | 33.2 | 0.53 | 35 |
| | | | | | | | | STA | 111.1 | 118.0 | 8.2 | 16.5 | | |
| 3 | " | " | 850 | 50 | " | " | 20 | As Roll | 106.1 | 108.9 | 10.3 | 31.8 | 0.49 | 1 |
| | | | | | | | | STA | 113.5 | 118.3 | 9.1 | 18.3 | | |
| 4 | " | " | " | " | 1050 | " | 70 | As Roll | 104.2 | 109.3 | 9.8 | 28.6 | 0.64 | 106 |
| | | | | | | | | STA | 110.1 | 116.2 | 7.5 | 14.8 | | |
| | | | | | | | | INVENTION | | | | | | |
| 5 | 1050 | H | 850 | 50 | 950 | 800 | 30 | As Roll | 104.5 | 107.2 | 15.7 | 37.9 | 0.29 | 1 |
| | | | | | | | | STA | 118.1 | 122.9 | 14.1 | 36.0 | | |
| 6 | " | " | 900 | 30 | " | " | 70 | As Roll | 104.9 | 107.9 | 16.0 | 38.2 | 0.28 | 2 |
| | | | | | | | | STA | 118.4 | 123.1 | 14.6 | 35.9 | | |
| 7 | " | " | 850 | 50 | " | " | " | As Roll | 104.9 | 108.2 | 16.0 | 42.3 | 0.25 | 1 |
| | | | | | | | | STA | 118.2 | 123.5 | 14.2 | 38.6 | | |
| 8 | " | I *1 | 900 | 30 | " | " | " | As Roll | 104.8 | 108.1 | 16.2 | 39.0 | 0.28 | 0 |
| | | | | | | | | STA | 118.2 | 123.3 | 14.4 | 36.2 | | |
| 9 | " | J *1 | " | " | " | " | " | As Roll | 104.8 | 108.1 | 15.9 | 38.7 | " | 0 |
| | | | | | | | | STA | 118.2 | 123.2 | 14.5 | 36.0 | | |
| 10 | " | K *1 | " | " | " | " | " | As Roll | 104.9 | 107.7 | 16.3 | 38.8 | " | 0 |

TABLE 2-continued

| No | Slab producing conditions (Finish: 120 mm) B | D | C | E | Rolling condition (Cross ratio: 1) B | C | E | Treatments | Mechanical properties Y.S kg/mm² | T.S Kg/mm² | El Kg/mm² | RA (%) | F *2 | G |
|---|---|---|---|---|---|---|---|---|---|---|---|---|---|---|
| | | | | | | | | STA | 118.3 | 123.3 | 14.6 | 36.2 | | |

NOTE:
B - Heating temperatures (°C.); C - Finishing temperature (°C.); D - Heating furnaces; E - Total reduction rate (%) at temperatures of + phase range; F - Standard deviation of α crystalline grain diameter; G - Length (cm) of surface cracks; H - Atmospheric furnace; I - Vacuum furnace; J - Ar furnace; K - He furnace; RA - Reduction of area
*1 - Oxygen partial pressures are all 0.02 atm;
*2 - With respect to STA material (Solution Treatment and Aging), average grain sizes (average of 30 grains) of α crystallines in cross section in parallel to the rolling direction, were measured in 100 parts thereof, and standard deviation of the average grain diameter is shown.

What is claimed is

1. An improved method for producing Ti alloy plates, comprising heating an $\alpha+\beta$ Ti alloy ingot to a temperature within the $\alpha+\beta$ two phase range, forging or rolling said heated alloy ingot to reduce it more than 30% whereby strain energy accumulates in said ingot as it is being reduced, and reheating said reduced ingot containing said accumulated strain energy to a temperature of the $\alpha+\beta$ phase range and then hot rolling said reheated reduced ingot so that it is further reduced in an amount more than an additional 30% whereby said accumulated strain energy accelerates recrystallization during said hot rolling to produce a uniform alloy structure, the improvement comprising said heating and reheating being carried out in an atmosphere having not more than 0.02 atm oxygen partial pressure.

* * * * *